US007997957B2

(12) United States Patent
Fournand et al.

(10) Patent No.: US 7,997,957 B2
(45) Date of Patent: Aug. 16, 2011

(54) PROCESS FOR EDGING OPTICAL LENSES

(75) Inventors: Gerald Fournand, St. Petersburg, FL (US); Agnes De Leuze-Jallouli, St. Petersburg, FL (US); Bruce Keegan, St. Petersburg, FL (US)

(73) Assignee: Essilor International Compagnie Generale d'Optique, Charenton-le-Pont (FR)

( * ) Notice: Subject to any disclaimer, the term of this patent is extended or adjusted under 35 U.S.C. 154(b) by 126 days.

(21) Appl. No.: 12/279,681

(22) PCT Filed: Feb. 14, 2007

(86) PCT No.: PCT/EP2007/051450

§ 371 (c)(1),
(2), (4) Date: Aug. 15, 2008

(87) PCT Pub. No.: WO2007/093620

PCT Pub. Date: Aug. 23, 2007

(65) Prior Publication Data

US 2009/0059383 A1 Mar. 5, 2009

Related U.S. Application Data

(60) Provisional application No. 60/774,346, filed on Feb. 17, 2006.

(51) Int. Cl.
*B24B 1/00* (2006.01)

(52) U.S. Cl. ..... 451/43; 451/44; 451/54; 451/390; 351/159; 351/166; 351/177

(58) Field of Classification Search ..... 451/41, 451/43, 44, 54, 255, 256, 384, 390; 351/159, 351/166, 177
See application file for complete search history.

(56) References Cited

U.S. PATENT DOCUMENTS

| | | | | |
|---|---|---|---|---|
| 7,137,107 | B1 | 11/2006 | Katagiri et al. | 351/159 |
| 7,137,701 | B2 * | 11/2006 | Katagiri et al. | 351/159 |
| 7,278,906 | B2 | 10/2007 | Kawase et al. | 451/41 |

FOREIGN PATENT DOCUMENTS

JP 2004 157147 6/2004

* cited by examiner

*Primary Examiner* — Eileen P. Morgan
(74) *Attorney, Agent, or Firm* — Fulbright & Jaworski L.L.P.

(57) ABSTRACT

A process for edging an optical lens for conforming the optical lens to the size and shape of a lens frame into which the optical lens is to be accommodated, said process comprising: a) providing an optical lens having a convex surface, the convex surface being provided with an anti-smudge topcoat rendering the optical lens inappropriate for edging; b) fixing a mounting element on the convex surface of the optical lens, preferably on its center, by means of an adhesive pad adhering both to the mounting element and the convex surface of the optical lens to form a mounting element/optical lens assembly; c) placing the mounting element/optical lens assembly in a grinding machine so that the optical lens is firmly maintained; and d) edging the optical lens to the intended size and shape, wherein, prior to step (b) of fixing the mounting element, the anti-smudge topcoat on the convex surface of the optical lens is pre-treated with a solvent selected from the group consisting of alkanols and dialkylketones under a mechanical stress.

11 Claims, No Drawings

PROCESS FOR EDGING OPTICAL LENSES

This application is a national phase application under 35 U.S.C. §371 of International Application No. PCT/EP2007/051450 filed 14 Feb. 2007, which claims priority to U.S. Provisional Application No. 60/774,346 filed 17 Feb. 2006. The entire text of each of the above-referenced disclosures is specifically incorporated herein by reference without disclaimer.

The present invention relates to the field of edging optical lenses, such as ophthalmic lenses and more particularly coated ophthalmic lenses for conforming the lenses to the required dimensions and shapes of the lens frames in which they are intended to be accommodated.

An ophthalmic lens results from a series of molding and/or surfacing/buffing operations determining the geometry of both convex and concave optical surfaces of the lens, followed by appropriate surface treatments.

The last finishing step of an ophthalmic lens is an edging step consisting in machining the lens edge or periphery so as to conform the lens dimension and shape to the dimension and shape of the lens frame in which the lens is to be mounted.

This edging step is typically carried out on a grinding machine comprising abrasive wheels, for example diamond abrasive wheels, that perform the machining step as defined here above.

During this edging step, the lens is held by two axially-acting clamping elements of the grinding machine with its optical axis in register with the longitudinal axis of the clamping elements.

Therefore, before any edging step, a glass-holding step is performed which comprises:

- fixing a mounting element on the center of the convex surface of the ophthalmic lens by means of an adhesive pad adhering both to the mounting element and the convex surface of the ophthalmic lens to form a mounting element/ophthalmic lens assembly;
- placing the mounting element/ophthalmic lens assembly in a first axial clamping element; and
- moving a second axial claming element to come in abutment at the center of the concave surface of the ophthalmic lens;

whereby the ophthalmic lens is fixely held with its optical axis in register with the longitudinal axis of the axial clamping elements.

During the edging step, the relative movement of the ophthalmic lens and the abrasive wheel is controlled, generally digitally, so as to obtain the required size and shape for the ophthalmic lens.

This edging step generates a tangential torque on the ophthalmic lens which can result in the ophthalmic lens rotating relative to the mounting element if the ophthalmic lens is not sufficiently firmly held.

As a result of an inadequately performed edging step, the ophthalmic lens is purely and simply ruined.

Thus, it is absolutely imperative that the ophthalmic lens be firmly and safety held during the edging step.

Efficient holding of the ophthalmic lens mainly depends on a good adhesion at the interface between the adhesive pad and the convex surface of the ophthalmic lens.

The latest generations of ophthalmic lenses most often comprise on their convex surfaces a hydrophobic and/or oil-repellent anti-stain topcoat (anti-smudge topcoat) usually associated with an anti-reflection coating.

The topcoats are most often made of materials, such as fluorosilane-type materials, that reduce the surface energy so as to prevent adhesion of greasy stains which are thereby easier to remove. Typically these materials have surface energies (as measured by the Owens-Wendt method) of less than 14 mJ/m$^2$, preferably of 12 mJ/m$^2$ or less, usually ranging from 1 to 12 mJ/m$^2$, preferably from 8 to 12 mJ/m$^2$.

One of the problems associated with this type of surface coating is that they achieve such an efficiency that the adhesion at the interface adhesive pad/convex surface is altered to such as an extent that safe edging of the ophthalmic lens cannot be performed.

This is particularly the case for polycarbonate ophthalmic lenses, the edging of which results in much more important stresses than for other materials.

To solve this problem it has been proposed, before performing the edging step, to form on the topcoat a temporary layer of a mineral or organic material that raises the surface energy of the convex surface of the lens up to at least 15 mJ/m$^2$ in order to ascertain good adhesion to the adhesive pad and therefore a safe edging of the lens.

Although the use of such a temporary layer results in safe edging of the lens, it lengthens and increases the cost of the manufacturing of the final lens.

Thus, the aim of the invention is to provide a lens edging process which is safe and does not necessitate applying a temporary layer on the convex surface of the lens.

According to the invention, there is provided an optical lens edging process for conforming the optical lens to the size and shape of a lens frame into which the optical lens is to be accommodated, said process comprising:

a) providing an optical lens having a convex surface, the convex surface being provided with an anti-smudge topcoat rendering the optical lens inappropriate for edging;
b) fixing a mounting element on the convex surface of the optical lens, preferably on its center by means of an adhesive pad adhering both to the mounting element and the convex surface of the optical lens to form a mounting element/optical lens assembly;
c) placing the mounting element/optical lens assembly in a grinding machine so that the optical lens is firmly maintained; and
d) edging the optical lens to the intended size and shape wherein, prior to step (b) of fixing the mounting element, the anti-smudge topcoat on the convex surface of the optical lens is pre-treated with a solvent selected from the group consisting of alkanols and dialkylketones under a mechanical stress.

The invention also contemplates an optical lens, in particular an ophthalmic lens, having a convex surface provided with an anti-smudge topcoat rendering the lens inappropriate for edging, free of any temporary layer formed on the anti-smudge topcoat and whose topcoat has been treated with a solvent selected from the group consisting of alkanols and dialkylketones under a mechanical stress.

In the present application, it is meant under the term "optical lens" any optically transparent organic or mineral lens, in particular ophthalmic lens, either treated or not, depending whether it comprises one or several various type of coatings or whether it remains bare.

When the optical lens comprises one or more surface coatings, the expression "to coat the lens" means that a layer is applied on the lens outer coating.

The surface energies are calculated according to the Owens-Wendt method described in the following reference: "Estimation of the surface force energy of polymers", Owens D. K., Wendt R. G. (1969) J. APPL. POLYM. SCI, 13, 1741-1747.

The optical lenses to be edged using the process of the invention are lenses comprising an outermost hydrophobic and/or oil-repellent surface coating (anti-smudge topcoat) and preferably glasses comprising an anti-smudge topcoat laid onto a mono- or a multilayered anti-reflection coating.

They may be also deposited on the hard coats of hard coated lenses.

In fact, anti-smudge topcoats are generally applied onto lenses having an anti-reflection coating, more particularly in a mineral material, so as to reduce their strong tendency to staining, for example, towards greasy deposits.

As previously mentioned, the anti-smudge topcoats are obtained by the application, onto the anti-reflection coating surface, of compounds reducing the glass surface energy.

Such compounds are described in full detail in the prior art, for example, in the following documents U.S. Pat. No. 4,410,563, EP-0 203 730, EP-749 021, EP-844 265 and EP-933 377.

Silane-based compounds bearing fluorinated groups, more particularly perfluorocarbonate or perfluoropolyether group(s) are most often used.

By way of examples, silazane, polysilazane or silicon compounds can be mentioned which comprise one or more fluorinated groups such as mentioned here above.

A known method is to deposit onto the anti-reflection coating compounds bearing fluorinated groups and Si—R groups, R being a —OH group or a precursor thereof, preferably an alkoxy group. Such compounds are able to conduct, at the anti-reflection coating surface, directly or after hydrolysis, to polymerization and/or cross linking reactions.

The application of compounds reducing the lens surface energy is conventionally carried out by immersion of said lens into a solution, by centrifugation, by dip coating or by depositing in vapour phase, among others. Generally, the anti-smudge topcoat has a thickness lower than 10 nm and more preferably lower than 5 nm.

The invention is implemented on optical lenses comprising an anti-smudge topcoat imparting a surface energy lower than 14 mJoules/$m^2$ and preferably lower than or equal to 12 mJ/$m^2$.

Typically, the surface energy of the anti-smudge topcoat ranges from 1 to 12 mJ/$m^2$, preferably from 8 to 12 mJ/$m^2$.

One important feature of the invention is the pre-treatment of the anti-smudge topcoat on the convex surface of the optical lens with a selected solvent under a mechanical stress.

By "pre-treatment with a solvent under a mechanical stress" it is meant that a solvent is applied on the anti-smudge topcoat and that a mechanical stress is applied to the solvent at the surface of the topcoat either during application of the solvent or just after application of the solvent.

Typically, pre-treatment with a solvent under a mechanical stress comprises wiping the anti-smudge topcoat surface with a soft support imbibed with the solvent, such as a cloth imbibed with solvent or depositing the solvent on the surface of the anti-smudge topcoat and then rubbing the surface of the anti-smudge topcoat with a soft material, such as a dry cloth (KIMWIPES® from Kimberly Clark or a microfiber).

The solvent preferably needs to form a visible film on the surface of the lens and needs to be in large excess.

After the solvent pre-treatment, the anti-smudge topcoat surface is generally dried to eliminate excess of solvent. Such a drying may result from the rubbing with the soft material.

Of course, the applied mechanical stress must be such that it does not damage the anti-smudge topcoat.

Preferably, the edging of the optical lens must be performed shortly after the pre-treatment step, i.e., within 5 days but most preferably within 60 minutes after completion of the pre-treatment step.

As previously indicated the solvent is selected from alkanols, dialkylketones or mixtures thereof.

Preferred alkanols are $C_3$-$C_6$ alkanols such as n-propanol, isopropanol, butanols, pentanols and hexanols.

The most preferred alkanol is isopropanol (IPA).

Preferred dialkylketones are dialkyl ketones with $C_1$-$C_4$ alkyl groups such as acetone, dipropylketones and dibutylketones.

The most preferred dialkylketone is acetone.

As a result of the pre-treatment there is obtained an optical lens which is appropriate for safe edging. This means that after edging, the lens will have the required size and shape so as to be suitably inserted into the intended frame.

More precisely, such a result is achieved when the optical lens is subjected to a maximum off-centring of at most 2°, preferably at most 1° during the edging operation.

The following example illustrates the present invention.

EXAMPLE 1

5 polycarbonate toric lenses (power −8.00+2.00 cylinder) having both faces coated with a polysiloxane hard coat were coated on their convex surface with a topcoat OPTOOL DSX® product (a compound comprising perfluoropropylene units) commercialized by DAIKIN Industries.

The OPTOOL DSX® product in a liquid form was diluted in Demnum solvent (from DAIKIN Industries). The topcoat was then applied by dip coating.

The formed topcoat had a thickness of around 15 nm and a surface energy as measured by the Owens-Wendt method of 10 mJ/$m^2$.

Each of the lenses had a diameter of 65 mm and a central thickness of 1 mm.

The topcoat bearing convex surfaces of the lenses were then wiped with isopropanol as follows: a KIMWIPES® tissue from Kimberly-Clark was imbibed with isopropanol and was applied on the convex surface which was rubbed with this tissue by applying moderate manual pressure and manually rotating the lens at the same time and the excess IPA was dried using a dry KIMWIPES®.

The KIMWIPES® tissue is a paper fiber. The same experiment was done with microfiber cloth, and the same results were obtained. There must be preferably a large excess of solvent. The solvent needs to form a visible film on the surface of the lens and needs to be in large excess.

Just after the above pre-treatment, a mounting element was fixed at the center of the convex surfaces of the lenses by means of an adhesive pad (½ eye blocking pad from PSI) to form mounting element/lens assemblies. The assemblies were then placed in a Kappa edger from ESSILOR. The clamping was made of a ½ eye block and a 18 mm counter block. The setting of the grinding machine was set on polycarbonate with a medium pressure for clamping.

The cylinder of the toric lenses was set at 90°. Lenses were edged to frame. After edging cylinder angle was remeasured to determine off-centring.

Results are given in Table I.

TABLE I

| Lens | Contact angle (°) Water | Contact angle (°) Diiodomethane | Surface energy (Owens-Wendt) (mJ/m$^2$) | Dispersive component | Polar component | Cylinder initial angle (°) | Cylinder final angle after edging (°) |
|---|---|---|---|---|---|---|---|
| 1 | 108.17 | 93.84 | 12.82 | 11.04 | 1.784 | 90 | 90 |
| 2 | 110.1 | 98.13 | 11.17 | 9.362 | 1.809 | 90 | 89 |
| 3 | 103.63 | 93.42 | 14.14 | 11.23 | 2.907 | 90 | 90 |
| 4 | 107.61 | 93.66 | 13.02 | 11.13 | 1.887 | 90 | 89 |
| 5 | 104.2 | 99.32 | 12.51 | 8.92 | 3.588 | 90 | 90 |

For comparison 5 toric lenses, the same as above but not pretreated with IPA, were edged as above.

Results are given in Table II.

TABLE II

| Lens | Contact angle (°) Water | Contact angle (°) Diiodomethane | Surface energy Owens-Wendt) (mJ/m$^2$) | Dispersive component | Polar component | Cylinder initial angle (°) | Cylinder final angle after edging (°) |
|---|---|---|---|---|---|---|---|
| 1 | 114.68 | 96.9 | 10.68 | 9.83 | 0.8411 | 90 | 77 |
| 2 | 117.26 | 97.64 | 10.1 | 9.548 | 0.5509 | 90 | 69 |
| 3 | 115.32 | 105.13 | 8.364 | 6.936 | 1.429 | 90 | 81 |
| 4 | 113.92 | 103.99 | 8.899 | 7.302 | 1.597 | 90 | 87 |
| 5 | 113.99 | 95.78 | 11.13 | 10.27 | 0.8638 | 90 | 89 |

Thus, without the pre-treatment step of the invention, safe edging cannot be achieved.

EXAMPLE 2

Example 1 was repeated with 4 lenses, the same as in example 1, except that the pre-treatment comprised dipping the lens in IPA and then drying the convex surface of the lenses by wiping with a dry KIMWIPES®.

Results are given in Table III.

TABLE III

| Lens | Cylinder initial angle (°) | Cylinder final angle after edging (°) |
|---|---|---|
| 1 | 90 | 89 |
| 2 | 90 | 88 |
| 3 | 90 | 89 |
| 4 | 90 | 85 |

Comparative Example 3

Example 1 was repeated except that IPA was merely spread on the topcoated convex surfaces of the lenses and was dried for 3 hours.

Results are given in Table IV.

TABLE IV

| Lens | Cylinder initial angle (°) | Cylinder final angle after edging (°) |
|---|---|---|
| 1 | 90 | 69 |
| 2 | 90 | 87 |
| 3 | 90 | 91 |
| 4 | 90 | 70 |
| 5 | 90 | 61 |

Comparative Example 4

Example 1 was repeated with 4 lenses, except that the lenses were simply dipped in IPA and air dried.

Results are given in Table V.

TABLE V

| Lens | Cylinder initial angle (°) | Cylinder angle after edging (°) |
|---|---|---|
| 1 | 90 | 77 |
| 2 | 90 | 78 |
| 3 | 90 | 82 |
| 4 | 90 | 86 |

Comparative examples 3 and 4 demonstrate that without application of a mechanical stress during the solvent pre-treatment, safe edging cannot be achieved.

The invention claimed is:

1. A process for edging an optical lens comprising:

a) providing an optical lens having a convex surface, the convex surface being provided with an anti-smudge topcoat having a surface energy of 14 mJ/m$^2$ or less rendering the optical lens inappropriate for edging;

b) pre-treating the anti-smudge topcoat on the convex surface of the optical lens with an alkanol under a mechanical stress and drying the alkanol thereby rendering the optical lens appropriate for edging;

c) fixing a mounting element on the convex surface of the optical lens with an adhesive pad adhering both to the mounting element and the convex surface of the optical lens to form a mounting element/optical lens assembly;

d) placing the mounting element/optical lens assembly in a grinding machine so that the optical lens is firmly maintained; and e) edging the optical lens to the intended size and shape;

wherein the optical lens is conformed to the size and shape of a lens frame into which the optical lens is to be accommodated wherein the anti-smudge topcoat has a surface energy of 14 mJ/m$^2$ or less after steps (b) and (e) have been performed.

2. The process of claim 1, wherein the mounting element is fixed in the center of the convex surface of the optical lens.

3. The process of claim 1, wherein the alkanol is selected from $C_3$ to $C_6$ alkanols.

4. The process of claim 1, wherein the alkanol is isopropanol.

5. The process of claim 1, wherein pre-treatment with a solvent comprises wiping the solvent on the anti-smudge topcoat.

6. The process of claim 1, wherein the pre-treatment with a solvent comprises depositing the solvent on the anti-smudge topcoat and then rubbing the deposited solvent with a soft material.

7. The process of claim 1, wherein edging is performed within 5 days after completion of the pre-treatment.

8. The process of claim 1, wherein edging is performed within 60 minutes after completion of the pre-treatment.

9. The process of claim 1, wherein the anti-smudge topcoat has a surface energy of 12 $mJ/m^2$ or less.

10. An optical lens having a convex surface provided with an anti-smudge topcoat having a surface energy of 14 $mJ/m^2$ or less rendering the lens inappropriate for edging, free of any temporary layer formed on the anti-smudge topcoat, and topcoat of which has been pre-treated an alkanol under a mechanical stress.

11. The optical lens of claim 10, wherein the alkanol is isopropanol.

* * * * *